United States Patent [19]

Weissberger et al.

[11] Patent Number: 5,075,733

[45] Date of Patent: Dec. 24, 1991

[54] WEB CLEANING DEVICE FOR CLEANING TONER OFF AN IMAGE MEMBER

[75] Inventors: Edward Weissberger, Pittsford; Donald S. Rimai, Webster, both of N.Y.

[73] Assignee: Eastman Kodak Company, Rochester, N.Y.

[21] Appl. No.: 692,887

[22] Filed: Apr. 29, 1991

[51] Int. Cl.[5] ..... G03G 21/00

[52] U.S. Cl. ..... 355/300; 15/256.5; 355/296

[58] Field of Search ..... 355/296, 300, 303, 326, 355/327; 118/652; 15/100, 256.5

[56] References Cited

U.S. PATENT DOCUMENTS

| | | | |
|---|---|---|---|
| 3,654,654 | 4/1972 | Abreu et al. | 355/300 X |
| 4,499,849 | 2/1985 | Tomita et al. . | |
| 4,530,595 | 7/1985 | Itaya et al. . | |
| 4,557,588 | 12/1985 | Tomosada | 355/300 |
| 4,568,174 | 2/1986 | Stange | 355/300 |
| 4,853,741 | 8/1989 | Ku . | |
| 4,862,221 | 8/1989 | Tabuchi et al. . | |
| 4,927,727 | 5/1990 | Rimai et al. . | |
| 4,968,578 | 11/1990 | Light et al, . | |
| 5,005,051 | 4/1991 | Haruki et al. | 355/300 X |

*Primary Examiner*—A. T. Grimley
*Assistant Examiner*—Sandra L. Brase
*Attorney, Agent, or Firm*—Leonard W. Treash, Jr.

[57] ABSTRACT

A web cleaning device is particularly adapted for cleaning a small amount of toner off the photoconductive surface of an image member. A backing element for the web has a plurality of elongated protrusions which urge the web into a plurality of lines or bands of cleaning contact with the surface to be cleaned. Preferably, the protrusions are separated by distances which vary so that as the web is advanced the web presents a different footprint to the cleaning surface with a fresh web at at least two of the protrusions. Cleaning is enhanced by the application of an electric field urging toner toward the web.

7 Claims, 2 Drawing Sheets

WEB CLEANING DEVICE FOR CLEANING TONER OFF AN IMAGE MEMBER

BACKGROUND OF THE INVENTION

1. Field of the Invention

This invention relates generally to web cleaning devices for cleaning toner off an image surface, for example a photoconductive drum. It is particularly suitable for cleaning residual toner left on a photoconductive drum after an efficient transfer of a toner image, for example a transfer of toner image to a heat softened thermoplastic layer using a combination of heat and pressure.

2. Background Art

U.S. Pat. No. 4,927,727 to Rimai et al, and U.S. Pat. No. 4,968,578 to Light et al, suggest a transfer process using a combination of heat and pressure to transfer toner images to a heat softened thermoplastic layer on a receiving sheet. This process has been shown to provide efficient transfer of dry toners of extremely small size, for example, toners as small as 3.5 micron (average diameter). Transfer of as much as 99 percent of such a toner has been made under conditions in which electrostatic transfer is relatively ineffective. It provides a transfer mechanism usable in forming extremely high quality color toner images using a dry electrophotographic system.

Even though as little as 1 percent of the original toner image is left on the original image member, it must be cleaned off before that portion of the image member is re-used. This creates the demanding job of cleaning off only those toner particles most difficult to transfer in a very effective transfer system. Although the use of heat in the cleaning step in addition to its use in transfer may be effective in removing more toner, it is desirable not to subject the image member to such an additional heating step. Unfortunately, conventional heavy duty cleaning mechanisms, such as fur brush or magnetic brush cleaning, are not as efficient as the aforesaid transfer method in removing small particle toner from such an image member.

Since the introduction of plain paper desk-top copiers in the early 1960's, a disposable cleaning web has been used for light-duty image member cleaning. Typically, a cleaning web of cloth or paper is supplied on a supply spool, trained around a pressure roller and taken up on a take-up spool. The pressure roller is urged by a spring into contact with the image member to clean the image member according to the surface characteristics of the web and the amount of pressure applied by the pressure roller. The take-up roller is indexed periodically by its own separate motor, or by a substantially reduced drive between it and a main drive on the image-forming device, for example, the drive for a photoconductive drum.

U.S. Pat. No. 4,530,595 issued to Itaya et al., July 23, 1985 shows the use of an endless belt cleaning device in which a voltage is impressed between an image member and a cleaning web to create a field electrostatically transferring toner from the image member to the endless web. The endless web is cleaned at a position remote from the image member.

U.S. Pat. No. 4,862,221, issued to Tabuchi et al., Aug. 29, 1989, suggests a cleaning web having supply and take-up rolls and a pressure roller in which the web itself has an alternating concave and convex pattern arranged diagonally so that every portion of a cleaned surface is contacted by both the concave and convex part of the web.

U.S. Pat. No. 4,499,849 issued to Tomita et al., on Feb. 19, 1985 shows an endless cleaning web. A counter member having a variety of shapes performs the function of a backup for the cleaning web. Both concave and convex backup members are shown.

U.S. Pat. No. 4,853,741 to Ku, issued Aug. 1, 1989, shows a web cleaning device for cleaning the back of a photoconductive web which device includes supply and take-up rolls. The web is stretched around a film ski which also supports the photoconductive web. The web is indexed a small amount periodically during operation of the image-forming apparatus in which the photoconductive web is used.

DISCLOSURE OF INVENTION

It is the object of the invention to provide a web cleaning device for cleaning toner from a surface of an image member or another surface, which cleaning device is particularly effective, for example, is effective in cleaning difficult to clean small particle toners.

This and other objects are accomplished by a cleaning device having a cleaning web. The web is urged by a backing element into contact with a surface to be cleaned of toner. The backing element includes a plurality of elongated protrusions for contacting said web and urging it into cleaning contact with the surface. The protrusions provide lines or bands of high pressure between the web and the surface to be cleaned to effect cleaning.

According to a preferred embodiment, the web is a fibrous material and is indexed a small amount according to program or demand. The protrusions are spaced irregularly so that the protrusion footprint does not repeat itself.

The elongated protrusions create small areas of substantial pressure between the web and the surface to be cleaned, which pressure provides effective cleaning, especially cleaning of small particle toners remaining after a heat transfer process.

According to a preferred embodiment, the backing element is biased to create a field with the image member urging toner from the image member to the cleaning web.

The invention has particular use in a process of forming multicolor images in which a series of single color images are formed on an image member and transferred in registration using a combination of heat and pressure to a heat-softened surface. Such transfer processes are extremely efficient as mentioned above. The cleaning device, which is the subject of this invention is particularly useful in cleaning residual toner remaining after such a process because it is effective in picking up a small amount of very difficult to remove fine toner particles.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENT

This invention is in a device for cleaning toner from a surface in an image-forming apparatus. It can be used to clean any surface that retains or accumulates toner, whether it be on a drum or a web. However, it is particularly useable in apparatus such as that shown in FIG. 1 in which a relatively small amount of difficult to remove toner is to be cleaned.

Figure 1:
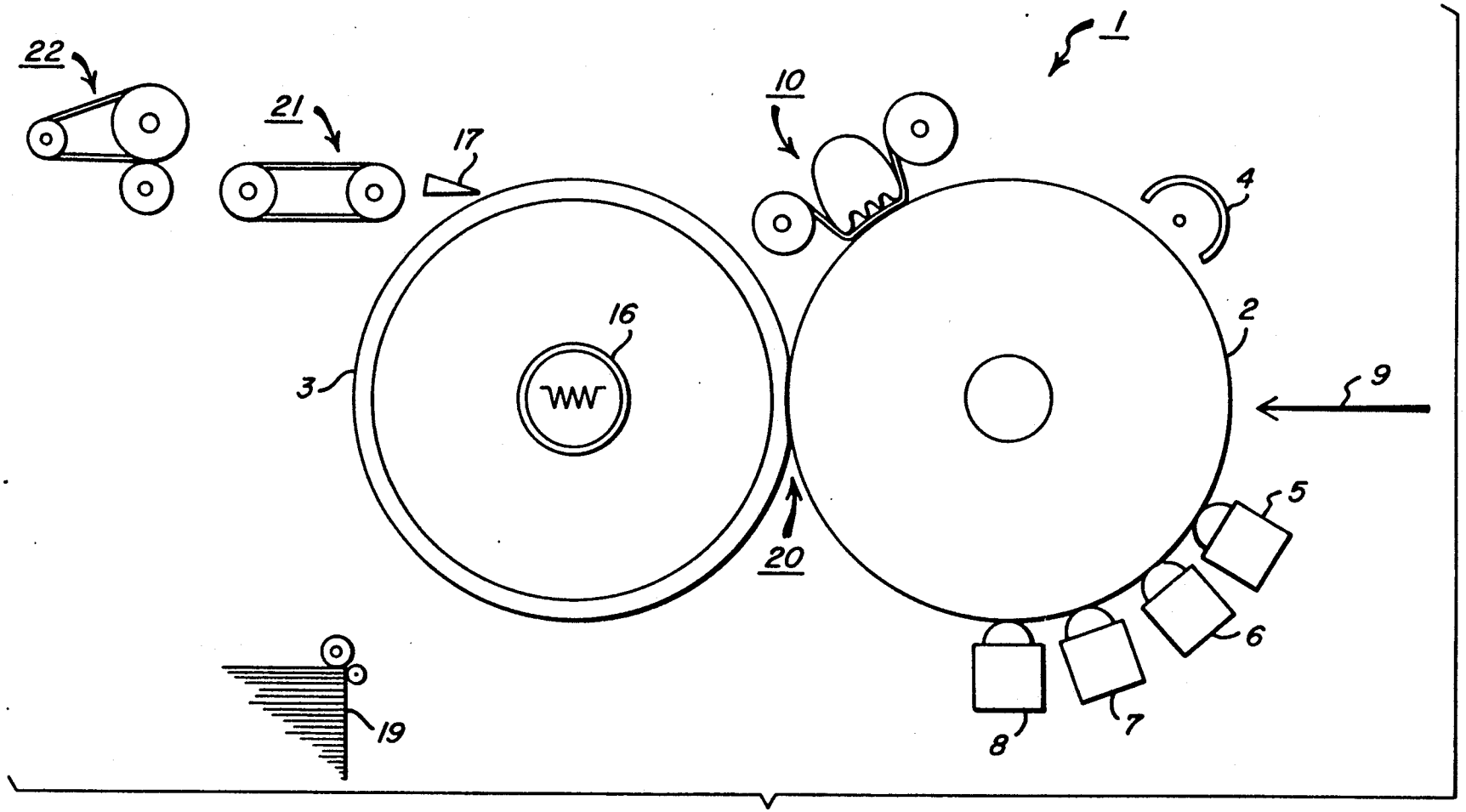
FIG. 1 is a side schematic view of an image-forming apparatus in which the invention is particularly useful.

According to FIG. 1, an image-forming apparatus 1 includes an image member, for example, a photoconductive drum 2 which is journaled for rotation past a series of electrophotographic stations for forming color toner images. Photoconductive drum 2 is uniformly charged by a charging device 4, imagewise exposed by an exposing device, for example laser 9 to create a series of electrostatic images, which series of electrostatic images correspond to color separations of a desired multicolor image. Each electrostatic image is toned with a different color toner by one of toning stations 5, 6, 7 or 8 to create a series of different color toner images on the surface of drum 2.

The series of different color images are transferred in registration to a receiving sheet carried by a transfer drum 3 at a transfer nip 20 and the surface of drum 2 is cleaned by a cleaning device 10 for reuse. The receiving sheet is fed from a receiving sheet supply 19 onto the surface of transfer drum 3 whereas it is held by a suitable means, for example, vacuum holes, gripping fingers or electrostatics. Transfer in nip 20 is accomplished by a combination of heat and pressure. The receiving sheet has a heat softenable outer layer which is softened by a heater 16 internal to transfer drum 3. Transfer drum 3 and photoconductive drum 2 are urged together with enough force to partially embed some of the toner in the series of toner images in the outer thermal plastic layer of the receiving sheet. The toner itself becomes sintered at least at the points of contact between toner particles thereby transferring nearly the entire toner image to the receiving sheet. Transfers approaching 99 percent of the toner making up the toner image have been obtained in this manner. For more details on this process, see U.S. Pat. Nos. 4,927,727 and 4,968,578, supra.

Once three or four toner images have been transferred in registration to the receiving sheet as it is recirculated by transfer drum 3 through nip 20, the receiving sheet is separated from transfer drum 3 by a separation device 17 and transported by a transportation device 21 to a fixing device 22. The resulting multicolor image can be treated to additional steps applying additional gloss or texture, cropping and the like and deposited in an output tray, the means for which are not shown in FIG. 1.

Because of the efficiency of transfer in nip 20, the small amount of toner left on photoconductive drum 2 represents only those toner particles that are most difficult to remove. The corona used in the process produces by-products on the drum surface such as corrosion or other chemical imperfections which must be removed. The heat used to effect the transfer in nip 20 can have a negative effect on the life and performance of the photoconductive surface. Therefore, it is desirable not to use heat in the cleaning step as well.

Figure 2:
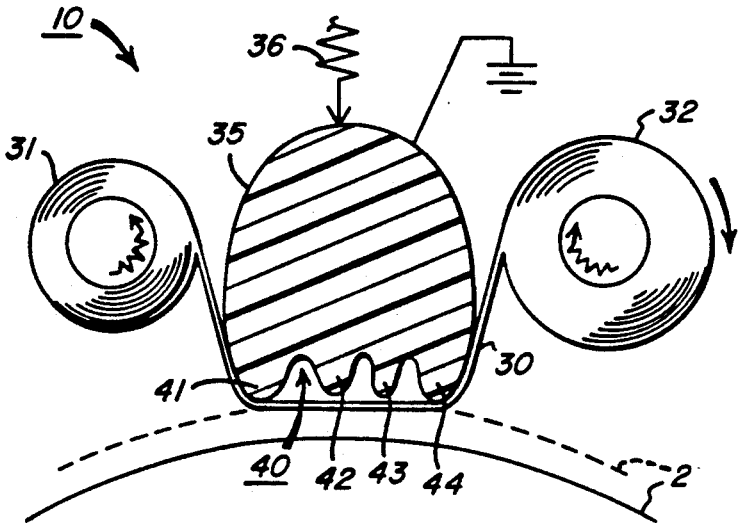
FIG. 2 is a side section of a cleaning device constructed according to the invention in a position slightly separated from a surface to be cleaned, with the operational position of the surface to be cleaned shown in phantom.
Figure 3:
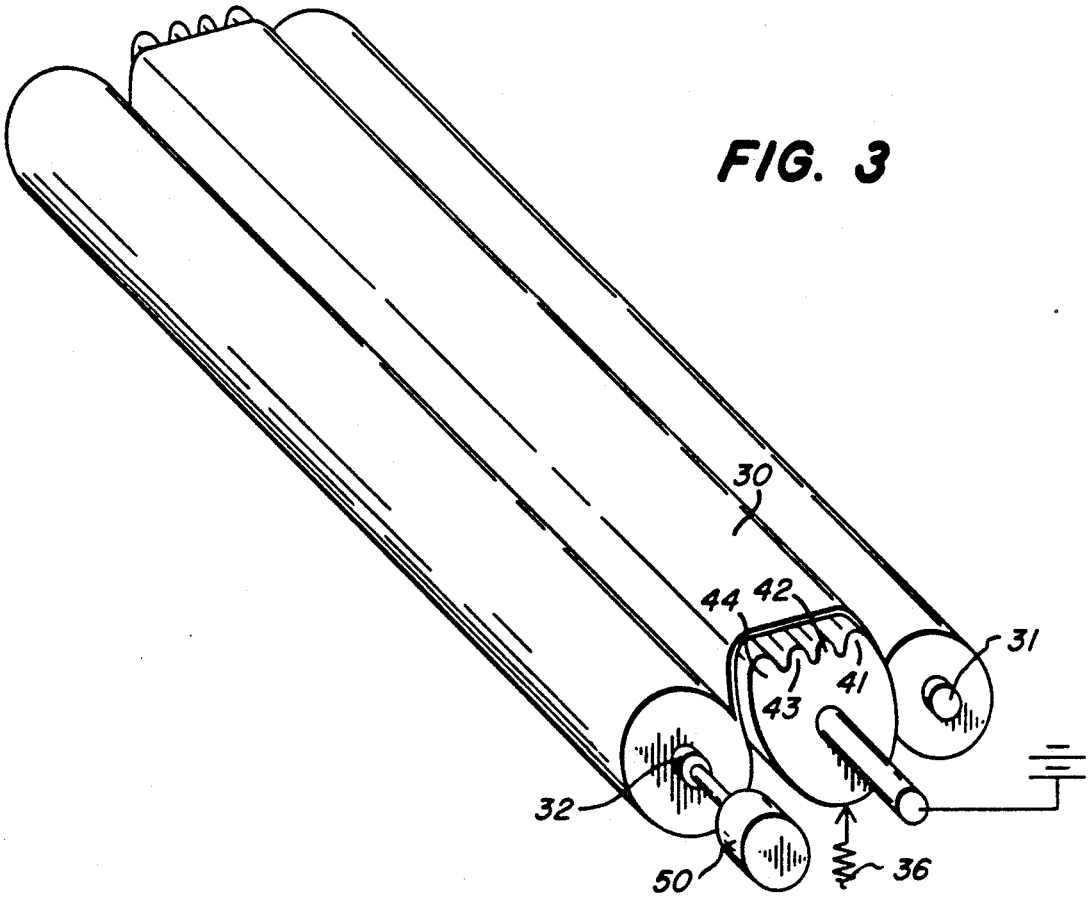
FIG. 3 is a perspective view of the device shown in FIG. 2 with the device inverted to illustrate its most significant features.

Cleaning device 10 is shown in detail in FIGS. 2 and 3. Cleaning device 10 includes a supply spindle 31 and a take-up spindle 32 for supplying a length of a cleaning web 30 across a backing element 35.

Cleaning web 30 is preferably a strip of material made of paper, cloth or other fibrous material, for example, rayon. It is urged into pressure contact with the surface of drum 2 by a backing element 35 which is urged toward drum 2 by a spring, shown schematically in FIGS. 2 and 3 at 36. FIG. 2 illustrates cleaning device 10 separated slightly from photoconductive drum 2 for clarity of illustration. In operation photoconductive drum 2 is in the position shown in phantom in FIG. 2.

Backing element 35 has a pressure surface 40 which is shaped into a plurality of elongated protrusions 41, 42, 43 and 44. The number of protrusions is not critical; for example, three or five could also be used. The tips of the protrusions form a concave arc to fit the surface of drum 2 with web 30 between them. Depending on the amount of force in spring 36, protrusions 41 through 44 impart substantial pressure along four elongated lines or bands across photoconductive drum 2.

Supply spindle 32 is advanced slowly according to a program or use. For example, supply spindle 32 can be geared to photoconductive drum 2 to advance one-quarter inch for every revolution of drum 2. Alternatively, as shown in FIG. 3, spindle 32 can be driven by a separate motor 50 according to use of the image-forming apparatus. For example, it can be advanced according to frames exposed with exposure device 9. Spindles 31 and 32 are both shown spring urged in a direction tending to take up web 30 in order to stretch web 30 across backing element 35. This rotary bias on take-up roller 32 is overridden by motor 50 when the web 30 is advanced. Obviously, web 30 can be advanced incrementally or continuously, but need be advanced only a very small amount with each rotation of photoconductive drum 2.

According to a preferred aspect of cleaning device 10, the protrusions 41 through 44 are spaced irregularly so that no given advancement of web 30 provides the same footprint of backing element 35. That is, protrusion 41 is spaced from protrusion 42 by a distance different from the distance protrusion 42 is spaced from protrusion 43 which in turn is spaced a different distance from protrusion 44.

Spring 36 should be strong enough to provide an average pressure between the web and the photoconductive drum 2 where backed by each of the protrusions of between 0.5 and 5.0 pounds per square inch. We found that a force of two and one-half pounds applied across a backing element backing a 12½ inch web with four relatively blunt protrusions as shown in FIGS. 2 and 3 created such pressures. With a different number of projections a different force would produce comparable pressures.

To further enhance cleaning, backing member 35 was biased to a potential creating a field urging the toner particles toward the web. For example, with negatively charged toner particles, a bias of +500 volts on backing element 35 compared to an aluminum core on photoconductive drum 2 provided enhanced cleaning. Using the bias and pressures indicated above. Device 10 provided excellent removal of toner. It also removed corona induced corrosion and unwanted ions from the photoconductive surface without substantially scratching the surface of photoconductive drum 2 and without releasing small toner particles into the air.

The electrical bias can be applied as shown in FIG. 3 to a metallic shaft for backing element 35 which shaft also can be used for applying the force from spring 36. Preferably, backing element 35 is made of a plastic having enough carbon particles dispersed therein to be somewhat conductive to assist in applying the field.

The image-forming device 1 is designed to provide extremely high quality multicolor images with extremely small toner particles, for example, particles as small as three and one-half microns in diameter. The cleaning device disclosed herein is particularly effective compared with fur brush cleaners, blade cleaners and soft rollers in cleaning such small particles. It also buffs the surface to remove induced corrosion.

Although the invention is shown in cleaning toner off an image member after transfer for which function it is particularly suitable, it also can be used to clean other surfaces in an image-forming apparatus which collect toner, for example, it can be used to clean the transfer drum 3 which collects a small amount of airborne toner. In other similar apparatus in which toner is transferred directly to the surface of a transfer drum and then transferred in a single step from the transfer drum to a receiving sheet, the cleaning device 10 would also be particularly effective for cleaning the transfer drum, especially if those transfers are efficient and leave only a small amount of difficult to clean toner.

The invention has been described in detail with particular reference to a presently preferred embodiment, but it will be understood that variations and modifications can be effected within the spirit and scope of the invention.

We claim:

1. A web cleaning device for cleaning toner off a moving surface in an image-forming apparatus, said cleaning device comprising:

a cleaning web having a cleaning side and an opposite side;

means for positioning a length of said web in a cleaning position, said means including a backing element positioned to engage said opposite side of said web, said element having a plurality of elongated protrusions for contacting said web and for urging it into cleaning contact with the surface to be cleaned, said protrusions running generally across the direction of movement of the surface to be cleaned; and means for urging said backing element toward a surface to be cleaned to urge said protrusions into said cleaning web to force said web into cleaning engagement with the surface to be cleaned.

2. A web cleaning device according to claim 1 wherein said backing element includes at least first, second and third elongated spaced protrusions, said first and second protrusions being spaced by a distance different from the spacing between the second and third protrusions.

3. A web cleaning device according to claim 1 including means for creating an electric field of a direction urging toner on the surface to be cleaned toward the web.

4. A web cleaning device according to claim 2 wherein said protrusions have tips contacting said web, which tips form an arc shaped to be complementary to an arcuate surface to be cleaned and the web is composed of a fibrous material.

5. A web cleaning device according to claim 2, wherein said means for positioning a length of said web in a cleaning position includes supply and take-up spindles and said device further includes means for rotating said take-up spindle to incrementally advance the cleaning web with respect to the backing element.

6. An image-forming apparatus comprising:

an image member moveable through an endless path, means for forming a series of electrostatic images on said image member, means for applying toner of different colors to said electrostatic images to create a series of toner images of different colors, means for applying heat and pressure to said toner images to transfer said toner images in registration to a heat softened surface, said transferring means being effective to transfer in excess of 98 percent of said toner images, and a cleaning device for cleaning said image member after such transfer, characterized in that said cleaning device includes, means for providing a length of cleaning web, said web having a cleaning side and an opposite side, and pressure means for contacting the opposite side of said web, said pressure means including a plurality of elongated protrusions running in a generally cross-track direction with respect to said image member, and means for urging said pressure means toward said image member to urge said protrusions into said cleaning web to force said web into cleaning engagement with said image member along a plurality of bands corresponding to said protrusions.

7. An image-forming apparatus according to claim 6, wherein said cleaning device further includes means for creating an electric field of a direction urging toner on said image member toward said cleaning web.

* * * * *